US008432701B2

(12) United States Patent
Katano

(10) Patent No.: US 8,432,701 B2
(45) Date of Patent: Apr. 30, 2013

(54) STORAGE DEVICE AND STORAGE SYSTEM INCLUDING STORAGE DEVICE

(75) Inventor: Katsuhisa Katano, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 307 days.

(21) Appl. No.: 13/006,169

(22) Filed: Jan. 13, 2011

(65) Prior Publication Data

US 2011/0174815 A1 Jul. 21, 2011

(30) Foreign Application Priority Data

Jan. 20, 2010 (JP) ..... 2010-010404

(51) Int. Cl.
*H05K 5/00* (2006.01)

(52) U.S. Cl.
USPC ..... 361/732; 361/801; 361/803

(58) Field of Classification Search ..... 361/800–803, 361/728–732; 292/139, 150, 302, 207
See application file for complete search history.

(56) References Cited

U.S. PATENT DOCUMENTS

| | | | | |
|---|---|---|---|---|
| 5,490,791 | A * | 2/1996 | Yamada et al. | 439/159 |
| 5,889,649 | A * | 3/1999 | Nabetani et al. | 361/679.38 |
| 6,373,706 | B1 * | 4/2002 | Kasahara et al. | 361/725 |
| 6,402,529 | B2 * | 6/2002 | Saito et al. | 439/74 |
| 7,133,296 | B2 * | 11/2006 | Choi et al. | 361/798 |
| 8,070,520 | B2 * | 12/2011 | Zhu et al. | 439/630 |

FOREIGN PATENT DOCUMENTS

| | | | |
|---|---|---|---|
| JP | 8-255988 | A | 10/1996 |
| JP | 2003-281850 | A | 10/2003 |

* cited by examiner

*Primary Examiner* — Hung S Bui
(74) *Attorney, Agent, or Firm* — Fujitsu Patent Center

(57) ABSTRACT

A storage device for storing units includes, a housing, wherein selective insertion of one of a first unit and a second unit that respectively have different shapes is possible, a stopper positioned such that movement is possible between an initial position, a first position wherein insertion of the first unit is allowed and insertion of the second unit is prevented, and a second position wherein insertion of the second unit is allowed and insertion of the first unit is prevented, wherein insertion of the first unit moves the stopper from the initial position to the first position and insertion of the second unit moves the stopper from the initial position to the second position, and a lock capable of locking the stopper into one of the first position and the second position.

7 Claims, 12 Drawing Sheets

STORAGE DEVICE AND STORAGE SYSTEM INCLUDING STORAGE DEVICE

CROSS-REFERENCE TO RELATED APPLICATION

This application is related to and claims priority to Japanese Patent Application No. 2010-010404, filed on Jan. 20, 2010, and incorporated herein by reference.

FIELD

Embodiments discussed herein relate to a storage device and a storage system including a storage device.

BACKGROUND

Conventional storage devices consist of a box wherein multiple types of units can be inserted. It is possible to set up a stopper in this kind of box that allows the insertion of certain types of units, and hinders the insertion of other types of units. A device for preventing improper insertion is recited in Japanese Laid-open Patent Publication No. 2003-281850.

Changing the type of unit for which insertion is to be prevented is possible by changing the position of the stopper in relation to the box. However, if the stopper is placed in the wrong position, it is possible that units for which insertion should not be prevented will in fact have their insertion prevented. In this way, there is a risk of setting up the device so that insertion prevention targets the wrong units.

SUMMARY

In accordance with an aspect of the present embodiment, a storage device for storing units includes, a housing, wherein selective insertion of one of a first unit and a second unit that respectively have different shapes is possible, a stopper positioned such that movement is possible between an initial position, a first position wherein insertion of the first unit is allowed and insertion of the second unit is prevented, and a second position wherein insertion of the second unit is allowed and insertion of the first unit is prevented, wherein insertion of the first unit moves the stopper from the initial position to the first position and insertion of the second unit moves the stopper from the initial position to the second position, and a lock capable of locking the stopper into one of the first position and the second position.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF THE EMBODIMENT

An embodiment is now described with reference to the drawings.

Figure 1A:
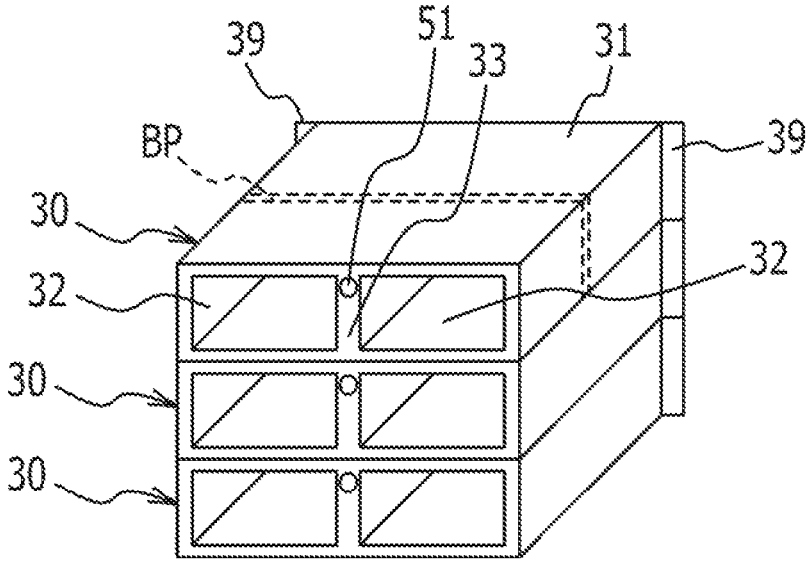
FIGS. 1A and 1B are descriptive diagrams of a storage device according to an embodiment.
Figure 1B:
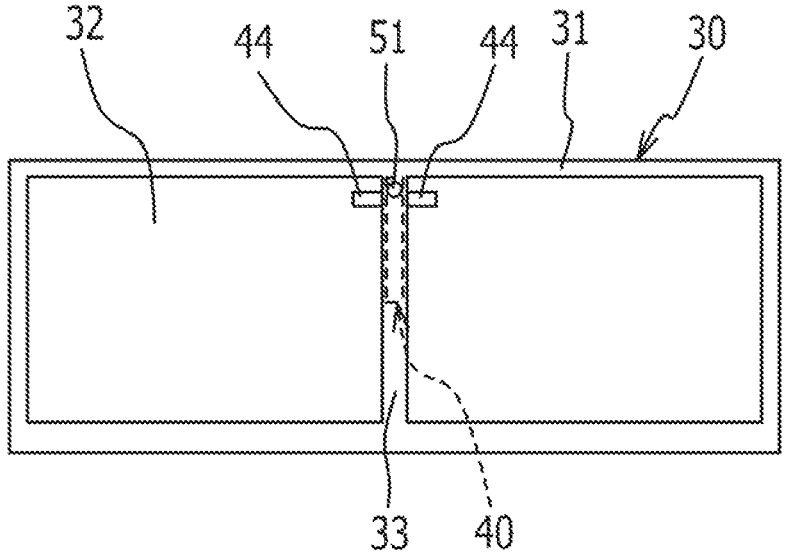

FIGS. 1A and 1B are descriptive diagrams of an embodiment of the storage device 30 discussed herein. FIG. 1A illustrates a plurality of connected storage devices 30. Each storage device 30 includes a connecting piece 39 to connect the device to a rack, not illustrated in the diagram. It is possible to connect a plurality of storage devices 30 to the same rack. A device having a plurality of connected storage devices 30 may be used as a server, storage, or other electronic system. The storage device 30 includes a housing 31, two openings 32 in the housing and a dividing wall 33 dividing the two openings 32. The housing may be a box, for example. An operating unit 51, which will be explained in detail later, is located on the dividing wall 33, for example.

Each storage device 30 includes a backplane BP. In FIG. 1A the openings 32 are provided on one side of a space divided by the backplane BP. An electricity source, a magnetic disk device, or other device is stored in the far end of the storage device 30 beyond the backplane BP. Units, to be discussed later, are inserted into the openings 32. A connecter is disposed on each unit, and the units are connected electrically to the backplane BP through the connectors. Units are thereby connected to the magnetic disk device or electricity source. FIG. 1B illustrates the front of storage device 30 including the openings 32. A stopper 40 is disposed inside the dividing wall 33. The stopper 40 includes two abutment portions 44 that project into the openings 32 on either side. The stopper 40 will be discussed in greater detail later.

Units, which are inserted into the storage device 30, will be discussed next.

Figure 2A:
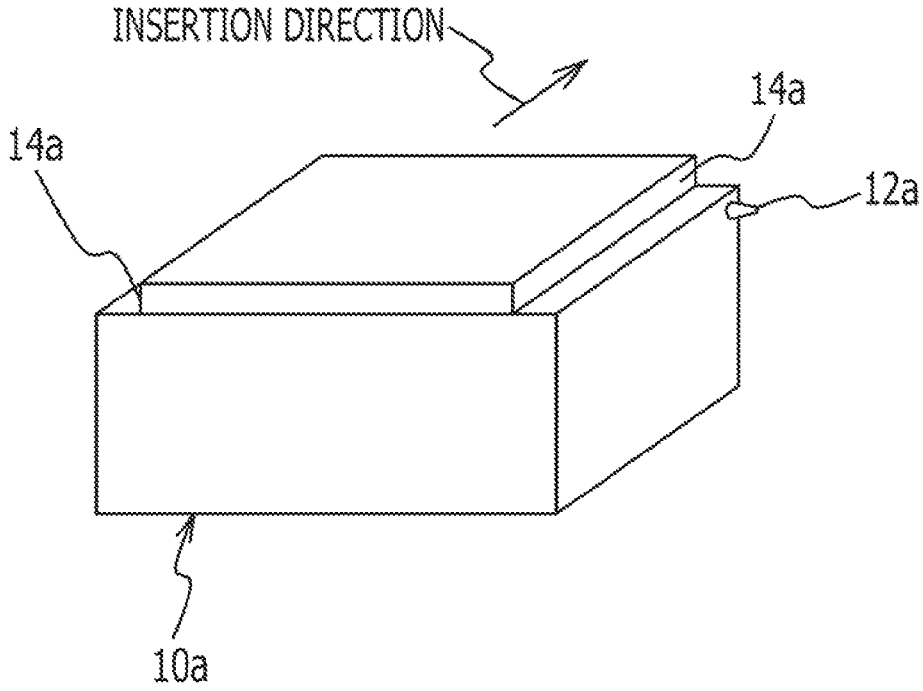
FIGS. 2A and 2B are descriptive diagrams of a first unit.
Figure 2B:
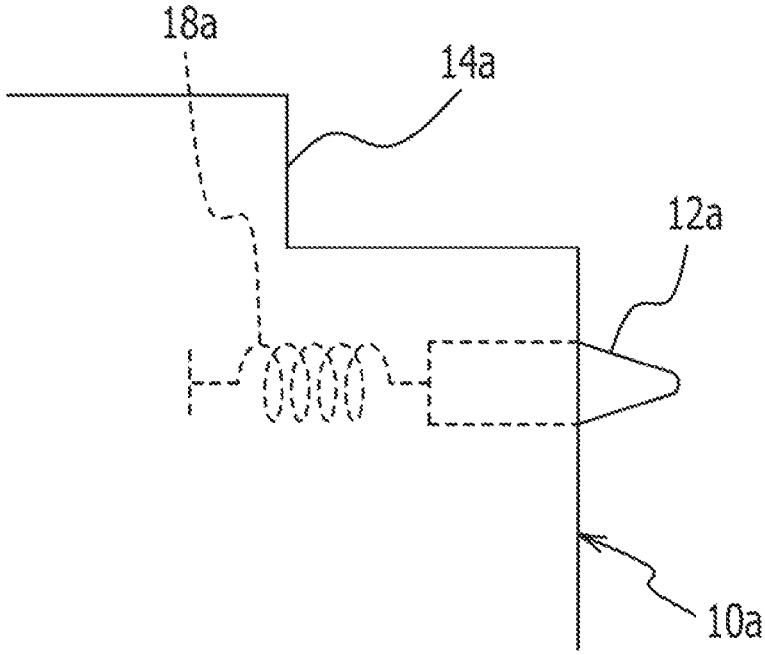

FIGS. 2A and 2B are descriptive diagrams of a first unit 10*a*. The first unit 10*a* may be a controller that controls a server, storage, or other electronic system. However, units are not restricted to devices with such functionality. Electronic elements such as a CPU, ROM, and RAM are contained in the first unit 10*a*. A first guiding pin 12*a* is disposed on a side of the first unit 10*a*. Another first guiding pin 12*a* is disposed on another side of the first unit 10*a*, not illustrated in FIG. 2A. The first guiding pins 12*a* project from either side of the first unit 10*a*. A first clearance area 14*a* is located on the upper portion of both sides of the first unit 10*a*. FIG. 2B is a diagram of the first guiding pin 12*a* and the first clearance area 14*a* as viewed from the front side of the first unit 10*a*. The first guiding pins 12*a* can move freely into and out of the sides of the first unit 10*a* by means of a force imparting member 18*a* housed inside the first unit 10*a*. The first clearance area 14*a* is recessed with respect to the side of the first unit.

Figure 3A:
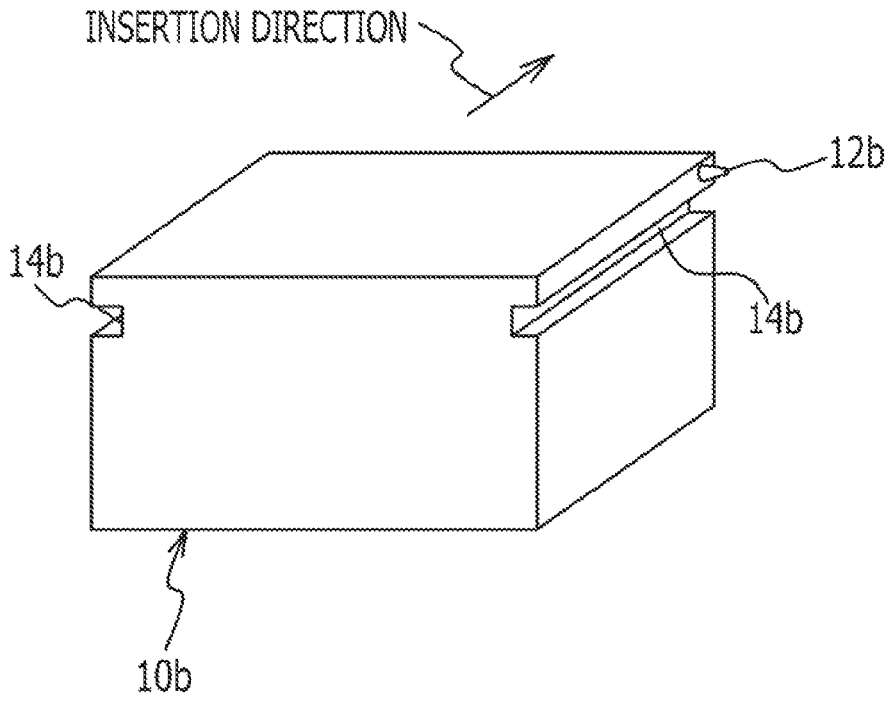
FIGS. 3A and 3B are descriptive diagrams of a second unit.
Figure 3B:
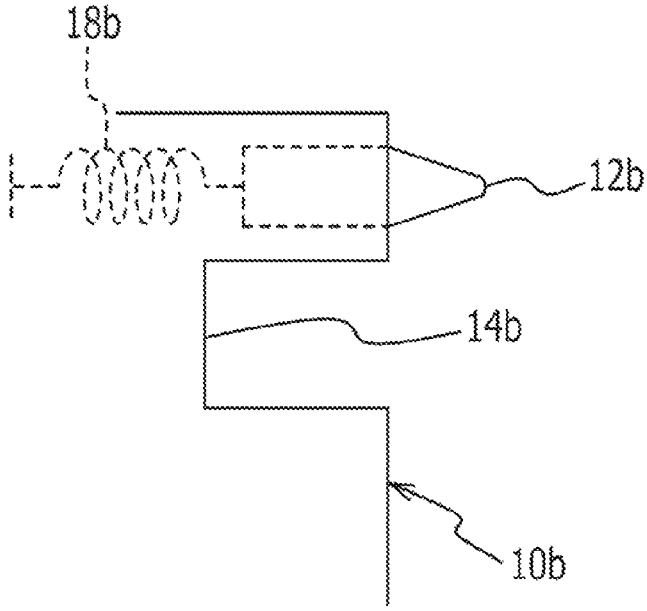

FIGS. 3A and 3B are descriptive diagrams of a second unit 10*b*.

The second unit 10*b* may be a switch that toggles between predetermined functionality. For example, the second unit 10*b* could route access when the user attempts to access a magnetic disk device inside storage device 30. However, the functionality of the second unit 10*b* is not limited in this way. Similarly to the first unit 10*a*, the second unit 10*b* houses electronic elements. A second guiding pin 12*b* and a second clearance area 14*b* are disposed on a side of the second unit 10*b*. The second clearance area 14*b* extends in the direction that the second unit 10*b* is inserted into the storage device 30. The second clearance area 14*b* is recessed. The second clearance area 14*b* may be positioned lower than the first clearance area 14*a* on the first unit 10*a*. However, the placement relationship of the first clearance area 14*a* to the second clearance area 14*b* is not restricted in this way, rather it suffices that the two areas have different placements. In this way the second unit 10*b* and the first unit 10*a* have different shapes. Similarly to the first unit 10*a*, the second guiding pin 12*b* can also move freely into and out of the sides of the second unit 10*b* by means of a force imparting member 18*b* housed inside the second unit 10*b*. The storage device 30 and the first unit 10*a*, or the storage device 30 and the second unit 10*b* together constitute a storage system.

Figure 4:
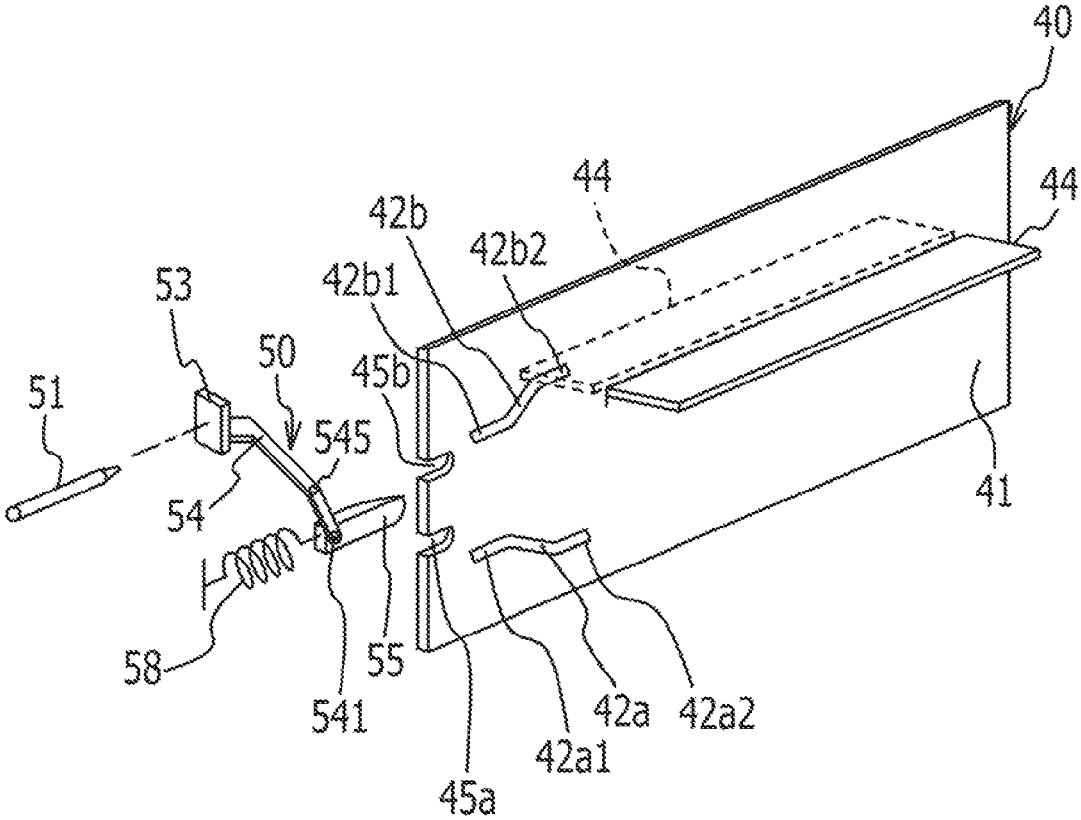
FIG. 4 is a perspective view of a stopper and a lock.

FIG. 4 is a perspective view of the stopper 40 and a lock 50.

The stopper 40 and the lock 50 are housed inside the dividing wall 33 of the storage device 30. The dividing wall 33 is not illustrated in FIG. 4. The stopper 40 includes a flat movable board 41. The moveable board 41 includes a first guidance recess 42*a*, a second guidance recess 42*b*, a first engagement groove 45*a* and a second engagement groove 45*b* disposed on the edge of the movable board 41, and the two abutment portions 44, projecting from both sides of the movable board 41.

The abutment portions 44 extend in the direction of insertion into the opening 32 of the first unit 10*a* or the second unit 10*b*. The abutment portions 44, which will be discussed in more detail later, function to inhibit and/or prevent the insertion of one of either the first unit 10*a* or the second unit 10*b*. The first engagement recess 45*a* and the second engagement recess 45*b* are disposed on the edge of the entrance side of opening 32. The first guidance recess 42*a* and the second guidance recess 42*b* are both long channels. The second guidance recess 42*b* and the second engagement recess 45*b* are disposed on the upper portion of the movable board 41, and the first guidance recess 42*a* and the first engagement recess 45*a* are disposed on the lower portion of the movable board 41.

The lock 50 includes the operating unit 51, a pressure panel 53, an arm 54, an engagement prong 55, and a force imparting member 58. A base end of the operating unit 51 projects out from the dividing wall 33. Specifically, the operating unit 51 projects from the dividing wall 33 out of the front side of the storage device 30. The operating unit 51 is set such that it can be pressed into the dividing wall 33. The operating unit 51 may be shaped like a pin as shown in FIG. 4. The tip of the operating unit 51 is abutted with the pressure panel 53. When an operator presses the operating unit 51, the pressure panel 53 is in turn pressed by the operating unit 51. The arm 54 is connected to the pressure panel 53. The pressure panel 53 is disposed at the base end of the arm 54. The pressure panel 53 may be shaped like a board as shown in FIG. 4.

An axial-hole 545 is disposed between the pressure panel 53 and the tip 541 of the arm 54. A supporting axis, not illustrated in FIG. 4, housed in the dividing wall 33 passes completely through the axial hole 545. In this way, the arm 54 is supported inside dividing wall 33 by the supporting axis such that revolution is possible. The engagement prong 55 is connected to the tip 541 of the arm 54. The engagement prong 55 engages with one of either the first engagement recess 45*a* or the second engagement recess 45*b* and will be discussed in greater depth later. The engagement between the engagement prong 55 and the first and second engagement recesses 45*a* and 45*b* changes based on the rotation of the arm 54. The force imparting member 58 imparts force on the stopper 40 such that the engagement prong 55 abuts with the stopper 40. The force imparting member 58 may be a coil spring, for example.

Figure 5:
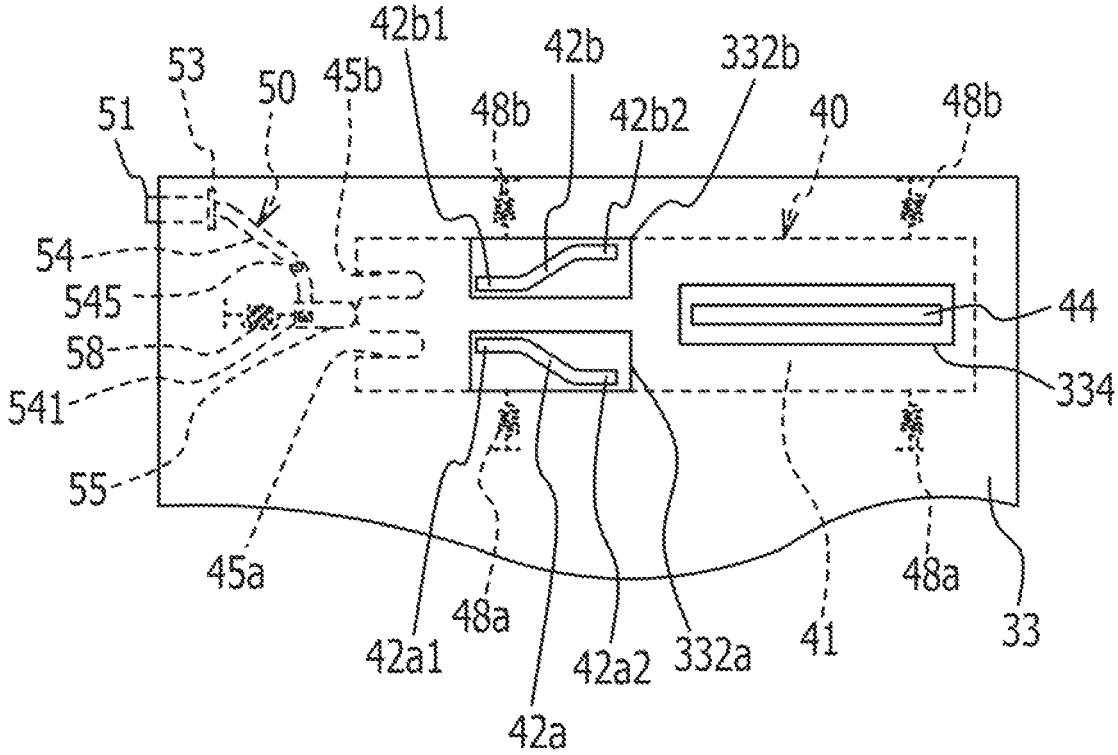
FIG. 5 is a diagram illustrating one side of a dividing wall.

FIG. 5 illustrates one side of the dividing wall 33.

The left side of FIG. 5 corresponds to the entrance side of opening 32. The right side of FIG. 5 corresponds to the deep side of opening 32. The stopper 40 is supported by the force imparting members 48*a* and 48*b* inside the dividing wall 33. The force imparting members 48*a* and 48*b* may be coil springs. Two force imparting members 48*a* are connected to the edge of the bottom of the movable board 41 and two force imparting members 48*b* are connected to the edge of the top of the movable board 41. Also, FIG. 5 illustrates the stopper 40 in a state wherein it is not locked into the lock 50. The position of the stopper 40 in this state is hereinafter referred to as the initial position.

Exposure holes 332*a*, 332*b*, and 334 are disposed on a side of the dividing wall 33 and function to expose the first guidance recess 42*a*, the second guidance recess 42*b*, and the abutment portions 44, respectively. When the stopper 40 is in the initial position, the first guidance recess 42*a*, the second guidance recess 42*b*, and the abutment portions 44 are exposed by the exposure the holes 332*a*, 332*b*, and 334, respectively. Note that the exposure hole 334, which exposes the abutment portions 44, is formed in such a way as to allow the movement of the abutment portions 44 accompanying the movement of the stopper 40. Note also that both sides of the dividing wall 33 are formed in the same manner.

The stopper 40 is supported by the force imparting members 48*a* and 48*b* in such a way as to be moveable in the vertical direction of FIG. 5. More detail will be given later, however the stopper 40 is supported in such a way that movement is possible between the initial position, a first position wherein the insertion of the first unit 10*a* is allowed while the insertion of the second unit 10*b* is prevented, and a second position wherein the insertion of the second unit 10*b* is allowed while the insertion of the first unit 10*a* is prevented. When the stopper 40 is in the initial position the engagement prong 55 abuts with the area between the first engagement recess 45*a* and the second engagement recess 45*b*.

Next, the movement of the stopper 40 from the initial position to the first position will be explained.

FIGS. 6A through 6C, 7A, and 7B are descriptive diagrams of the movement of the stopper 40 from the initial position to the first position. Note that what is explained herein is the situation wherein the stopper 40 is in the initial position before the first unit 10*a* is inserted. In FIGS. 6A through 6C, 7A, and 7B the exposure hole 332*a* of the dividing wall 33 and other elements are not illustrated. The first unit 10*a* is illustrated with a dashed line. The first clearance area 14*a* of the first unit 10*a* is illustrated by the diagonal dotted lines.

Figure 6A:
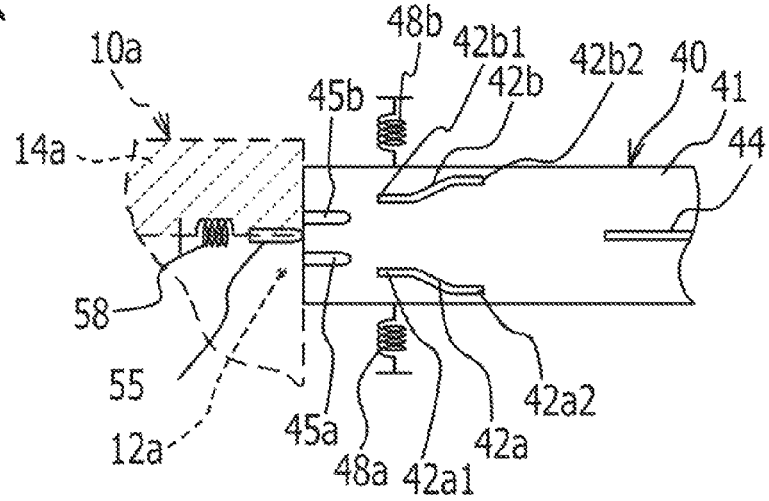
FIGS. 6A to 6C are descriptive diagrams illustrating the movement of the stopper from its initial position to a first position.

As illustrated in FIG. 6A, if the first unit 10*a* is inserted into the opening 32, the first unit 10*a* will move to the back of the opening 32 while the first guiding pin 12*a* rubs against the side of the dividing wall 33. As stated previously, the first guiding pin 12*a* is connected to the force imparting member

Figure 6B:
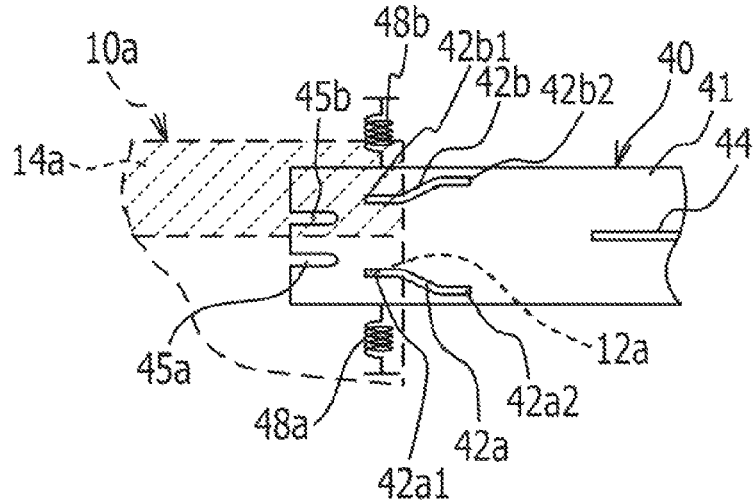

18*a*, so the abutment with the dividing wall 33 is preserved. As illustrated in FIG. 6B, when the first unit 10*a* moves to the back of the opening 32 as the first guiding pin 12*a* rubs against a side of the dividing wall 33, the first guiding pin 12*a* connects to the tip 42*a*1 of the first guidance recess 42*a*. Note that the first guiding pin 12*a* of the first unit 10*a* does not engage with the second guidance recess 42*b*.

Figure 6C:
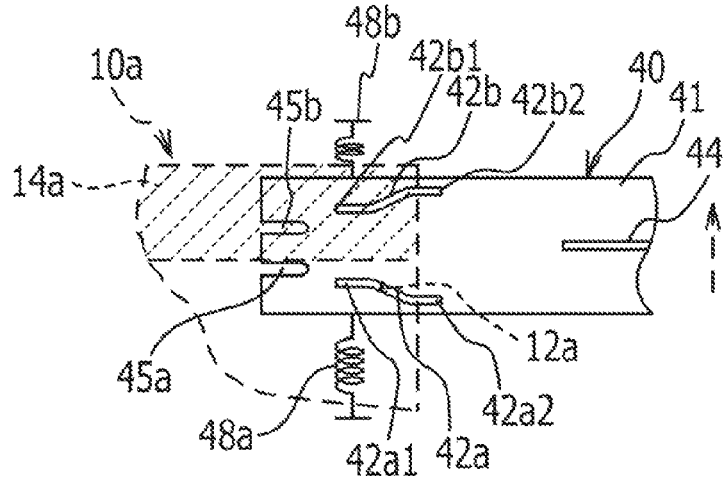

The first guidance recess 42*a* is located so as to engage with the first guiding pin 12*a* of the first unit 10*a* when the stopper 40 is in the initial position. Further, as illustrated in FIG. 6C, if the first unit 10*a* is inserted into the storage device 30, the first guiding pin 12*a* moves along the first guidance recess 42*a*. The first guidance recess 42*a* bends from the tip 42*a*1 to the base 42*a*2. The tip 42*a*1 is located at a higher position than the base 42*a*2. Therefore, when the first guiding pin 12*a* is moved from the tip 42*a*1 of the first guidance recess 42*a* to the base 42*a*2 thereof, the stopper 40 moves upwards with respect to the first unit 10*a* in resistance to the compression of the force imparting member 48*b* and the distention of the force imparting member 48*a*. In this way, the force imparting member 48*b* is compressed and the force imparting member 48*a* is extended. If the first unit 10*a* is further inserted into the storage device 30 and the first guiding pin 12*a* reaches the base 42*a*2, the engagement prong 55 engages with the first engagement recess 45*a*.

Figure 7A:
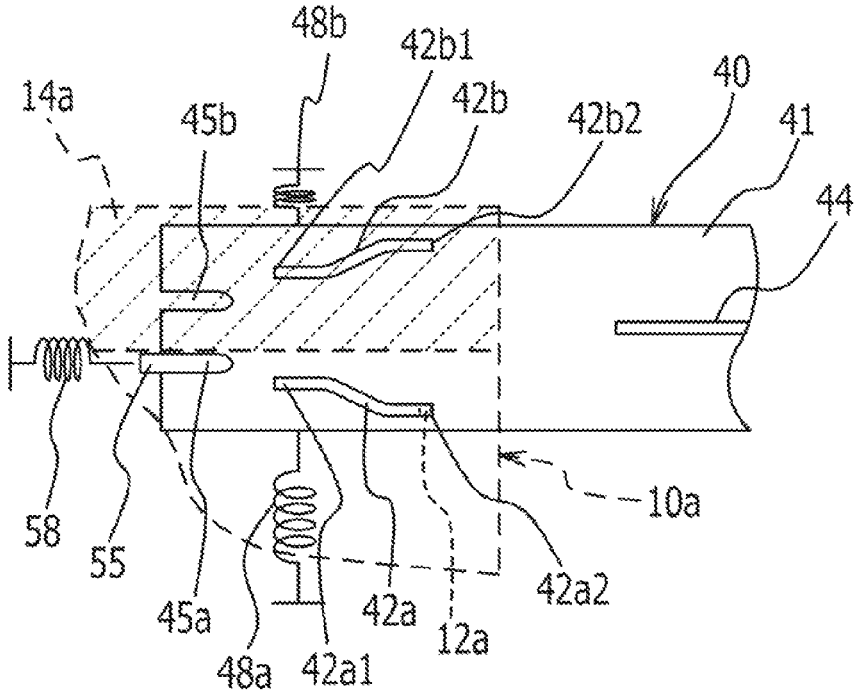
FIGS. 7A and 7B are descriptive diagrams illustrating the movement of the stopper from its initial position to the first position.
Figure 7B:
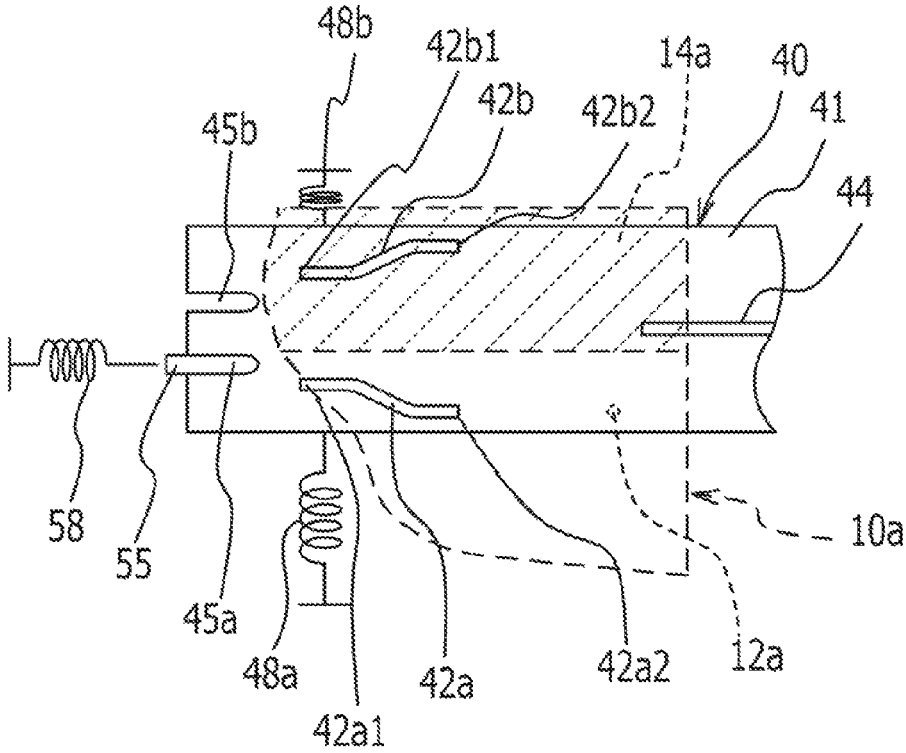

Also, the engagement between the engagement prong 55 and the first engagement recess 45*a* is maintained by the force added by the force imparting member 58. In this way, the stopper 40 is locked into the lock 50 in the first position. As illustrated in FIG. 7B, if the first unit 10*a* is further inserted into the storage device 30, the first guiding pin 12*a* will become removed from the first guidance recess 42*a* and the first unit 10*a* will move such that the first clearance area 14*a* passes the abutment portions 44. At such time, the abutment portions 44 do not abut with the first clearance area 14*a*. In this way, when the stopper 40 is in the first position the insertion of the first unit 10*a* is allowed.

Next, the situation wherein the stopper 40 is in the first position and the second unit 10*b* is inserted into the storage device 30 will be explained.

Figure 8:
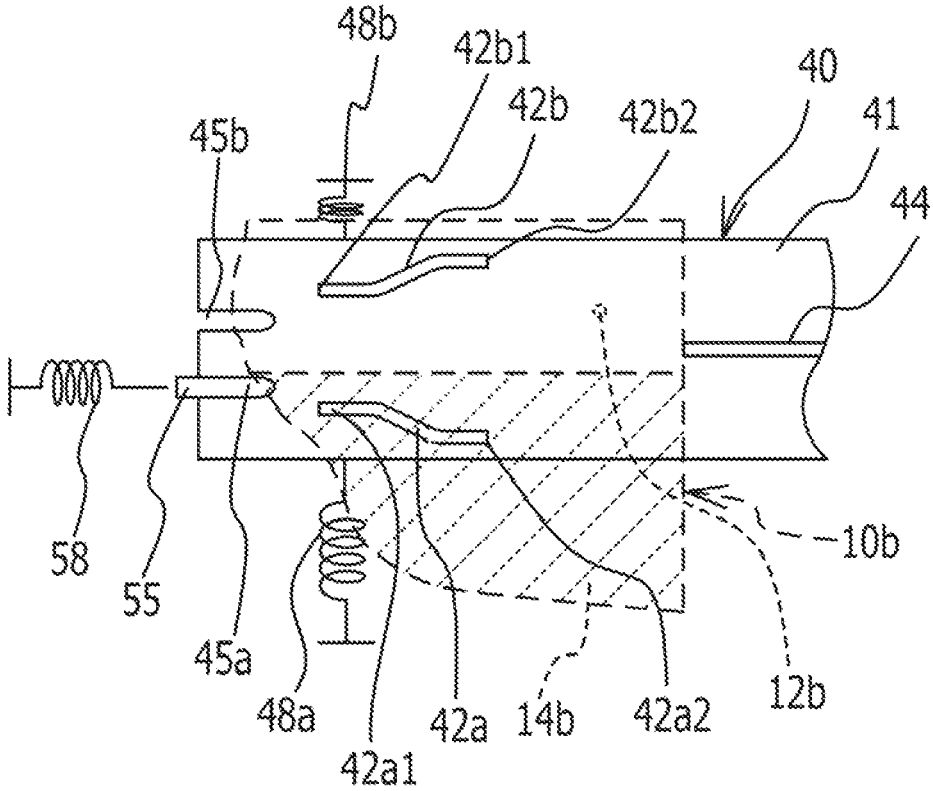
FIG. 8 is a descriptive diagram illustrating the situation wherein the second unit is inserted into the storage device with the stopper in the first position.

FIG. 8 is a descriptive diagram illustrating the situation wherein the second unit 10*b* is inserted into the storage device 30 with the stopper 40 in the first position. If the second unit 10*b* is inserted into the storage device 30 when the stopper 40 is in the first position, the abutment portions 44 abut with a side of the second unit 10*b*. In other words, the abutment portions 44 and the second unit 10*b* abut. In this way, when the stopper 40 is in the first position the insertion of the second unit 10*b* is prevented.

As described above, by inserting the first unit 10*a* into the storage device 30 when the stopper 40 is in the initial position, the stopper 40 can be moved from the initial position to the first position. In other words, by inserting the first unit 10*a* into the device 30 when the stopper 40 is in the initial position, the stopper 40 is set to the first position wherein the insertion of the first unit 10*a* is allowed but the insertion of the second unit 10*b* is prevented.

Next, the movement of the stopper 40 from the initial position to the second position will be explained.

Figure 9A:
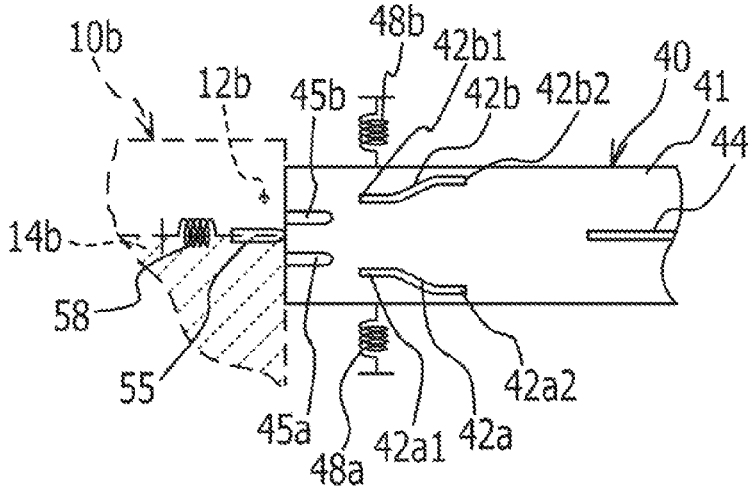
FIGS. 9A to 9C are descriptive diagrams illustrating the movement of the stopper from its initial position to a second position.

FIGS. 9A through 9C, 10A, and 10B are descriptive diagrams of the movement of the stopper 40 from the initial position to the second position. In FIG. 9A the second clearance area 14*b* of the second unit 10*b* is hatched with dotted lines.

Figure 9B:
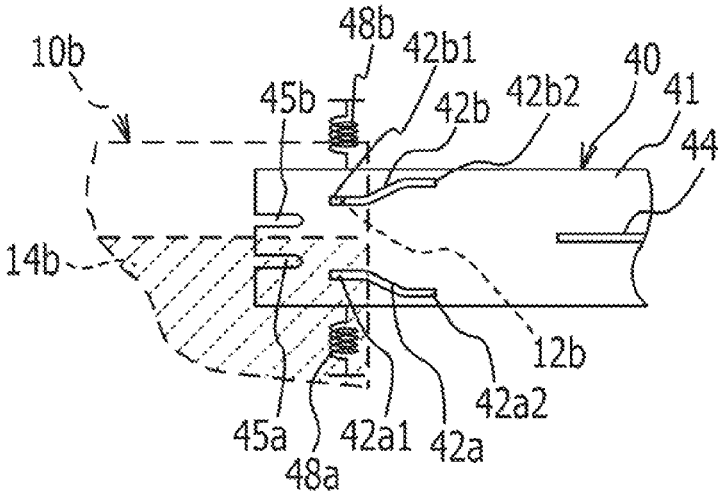
Figure 9C:
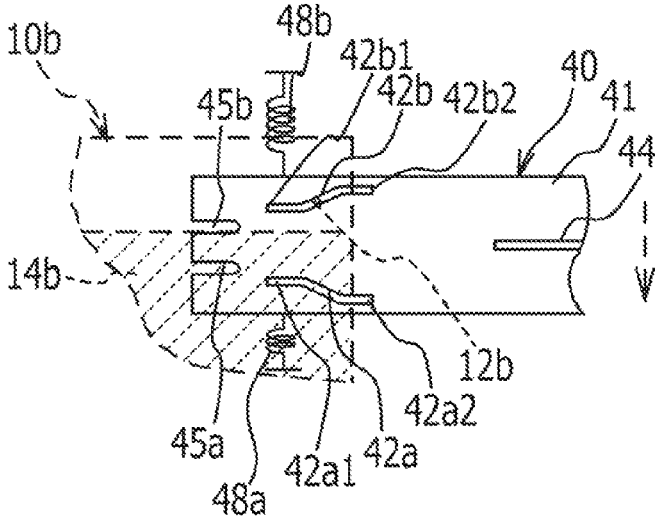

As illustrated in FIG. 9A, when the second unit 10*b* is inserted into the opening 32, the second guiding pin 12*b* engages with the tip of the second guidance recess 42*b* as illustrated in FIG. 9B. The second guidance recess 42*b* is located so as to connect with the second guiding pin 12*b* of the second unit 10*b* when the stopper 40 is in the initial position. As illustrated in FIG. 9C, if the second unit 10*b* is further inserted into the storage device 30, then the second guiding pin 12*b* will move inside the second guidance recess 42*b*. The second guidance recess 42*b* bends from the tip 42*b*1 to the base 42*b*2. The tip 42*b*1 is located at a lower position than the base 42*b*2. Therefore, when the second guiding pin 12*b* moves from the tip 42*b*1 to the base 42*b*2 the stopper 40 moves downward in relation to the second unit 10*b* in resistance to the compression of the force imparting member 48*a*. If the second unit 10*b* is further inserted into the storage device 30 and the second guiding pin 12*b* reaches the base 42*b*2 of the second guidance recess 42*b*, the engagement prong 55 engages with the second engagement recess 45*b*.

Figure 10A:
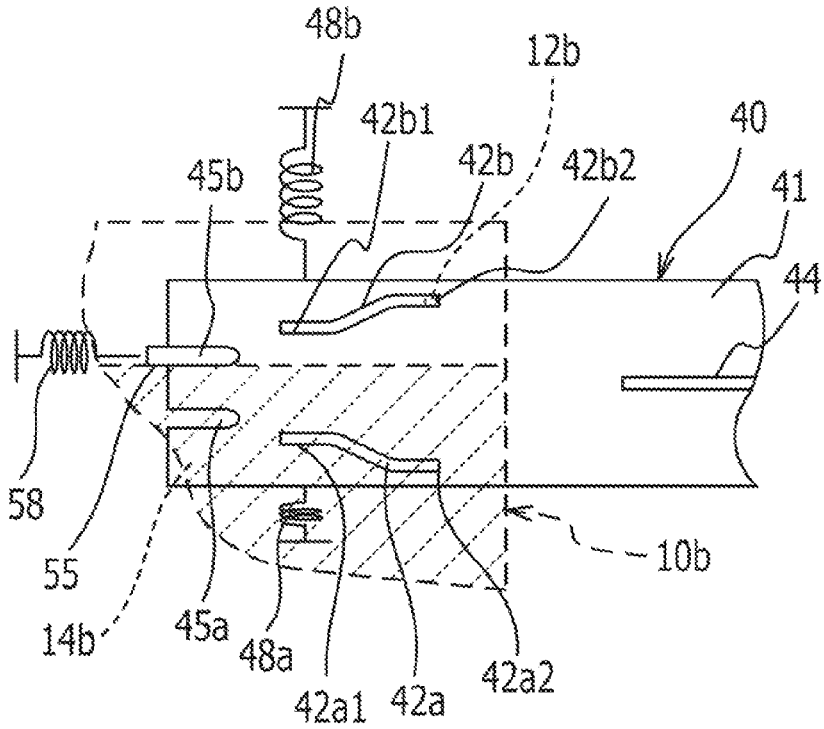
FIGS. 10A and 10B are descriptive diagrams illustrating the movement of the stopper from its initial position to the second position.
Figure 10B:
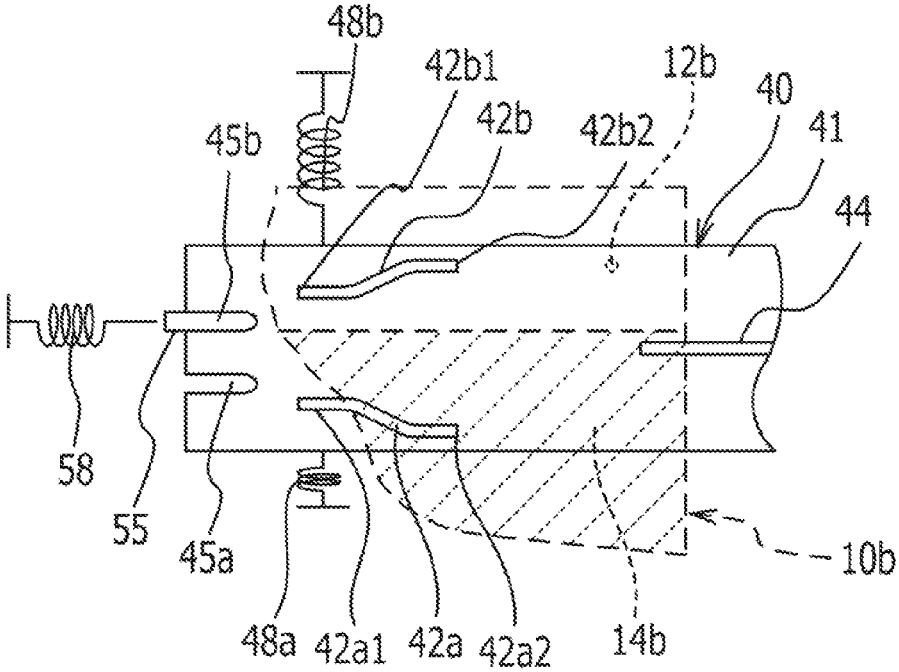

Also, the engagement between the engagement prong 55 and the second engagement recess 45*b* is maintained by the force added by the force imparting member 58. In this way, the stopper 40 is locked into the lock 50 in the second position. As illustrated in FIG. 10B, if the second unit 10*b* is further inserted into the storage device 30, the second unit 10*b* will move such that the second clearance area 14*b* will pass the abutment portions 44. At such time, the abutment portions 44 do not abut with the second clearance area 14*b*. In this way, when the stopper 40 is in the second position the insertion of the second unit 10*b* is allowed.

Figure 11:
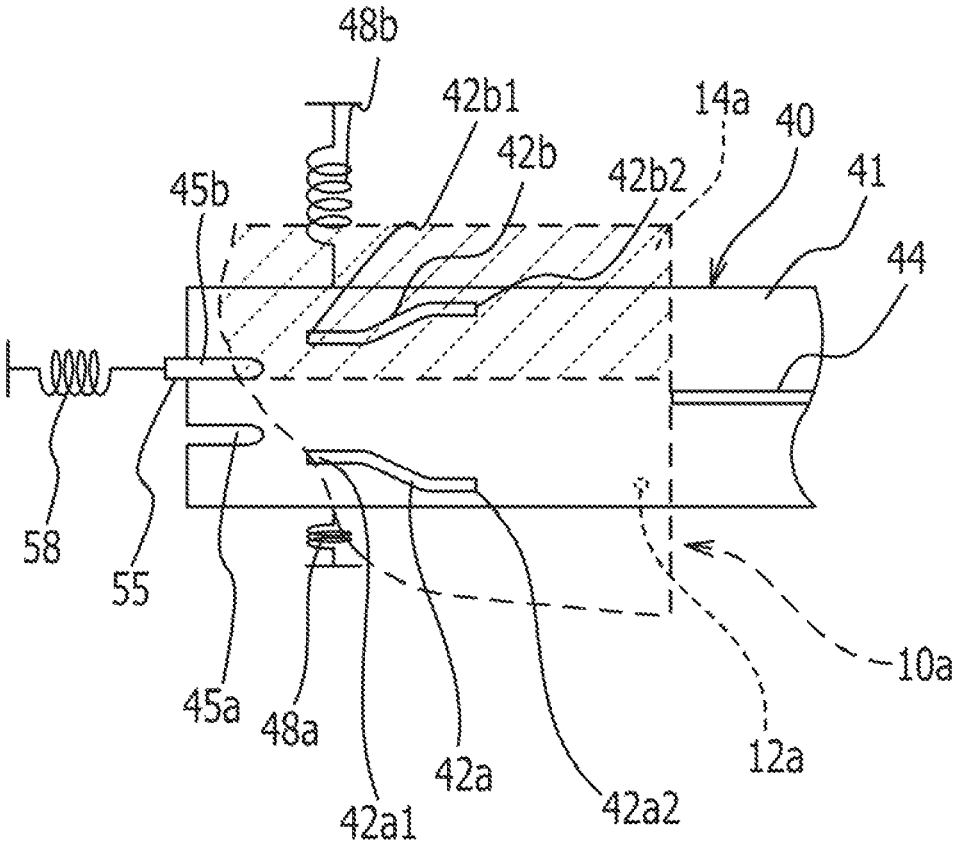
FIG. 11 is a descriptive diagram illustrating the situation wherein the stopper is in the second position and the first unit is inserted.

FIG. 11 is a descriptive diagram illustrating the situation wherein the first unit 10*a* is inserted into the storage device 30 with the stopper 40 in the second position.

If the first unit 10*a* is inserted into the storage device 30 when the stopper 40 is in the second position, the abutment portions 44 will abut with a side of the first unit 10*a*. In other words, the abutment portions 44 and the first unit 10*a* abut. In this way, when the stopper 40 is in the second position the insertion of the first unit 10*a* is prevented.

As described above, by inserting the second unit 10*b* into the storage device 30 when the stopper 40 is in the initial position, the stopper 40 can be moved from the initial position to the second position. In other words, by inserting the second unit 10*b* into the device 30 when the stopper 40 is in the initial position, the stopper 40 is set to the second position wherein the insertion of the second unit 10*b* is allowed but the insertion of the first unit 10*a* is prevented.

As described above, when the stopper 40 is in the initial position the type of insertion to be prevented is set by the type of unit inserted into the storage device 30. In other words, by inserting a unit into the storage device 30 the stopper 40 will be set such that insertion of units of a type other than the type of unit inserted into the storage device 30 will be prevented.

It is possible to change the type of unit for which insertion is to be prevented by changing the position of the stopper in relation to the housing. Nevertheless, it is still possible in such a case to set the stopper to an incorrect position. If the stopper is placed in the wrong position, it is possible that units for which insertion should not be prevented will in fact have their insertion prevented. In this way, there is a risk of setting up the device so that the prevention of insertion targets the wrong units.

By inserting a unit into the storage device 30 of the embodiment discussed herein, the device will prevent insertion of units of a type other than the type of the unit inserted therein. Accordingly, incorrect prevention of unit insertion is avoided.

Also, by inserting one of either the first unit 10*a* or the second unit 10*b* the stopper 40 will lock into either the first or the second position. It is therefore possible to set the stopper 40 and perform insertion at the same time, thus increasing efficiency.

Figure 12A:
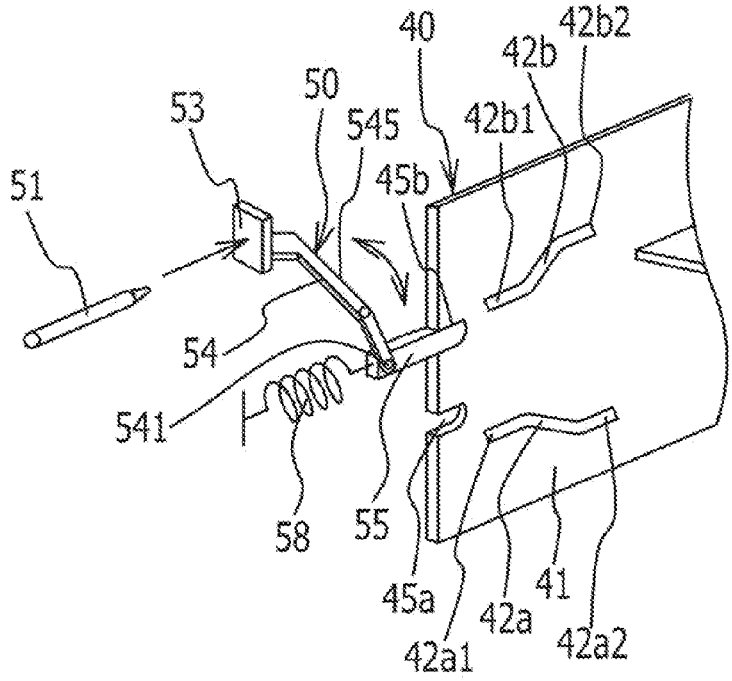
FIGS. 12A and 12B are descriptive diagrams illustrating the opening of the lock.
Figure 12B:
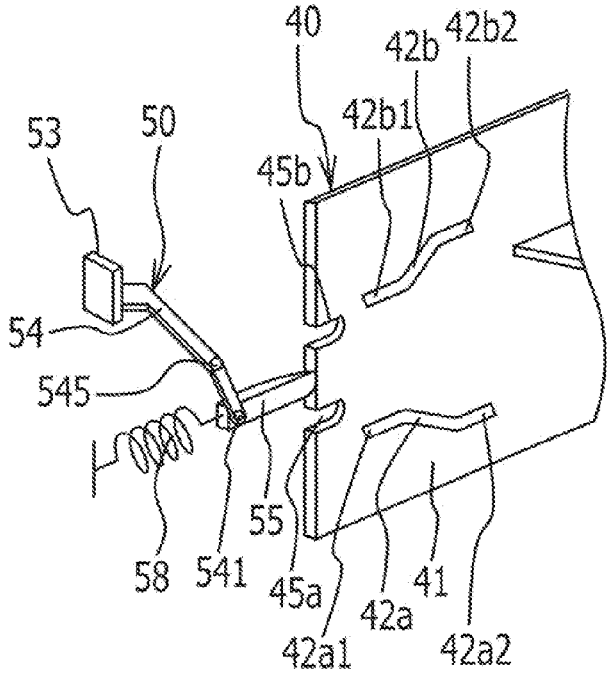

Next, release of the lock will be explained. FIGS. 12A and 12B are descriptive diagrams illustrating the release of the lock.

FIG. 12A illustrates the stopper 40 locked into the second position wherein the engagement prong 55 and the second engagement recess 45*b* are engaged. If an operator presses the operating unit 51 on the stopper 40 side when the stopper 40 is locked, the pressure panel 53 will be pressed toward the stopper 40 side. Thus the arm 54 revolves with a predetermined position as a support point. Specifically, the pressure panel 53 approaches the stopper 40 side and the arm 54 revolves such that the tip 541 of the arm 54 becomes removed from the stopper 40. The engagement prong 55 is connected to the tip 541 of the arm 54, so by this sort of rotation by the arm 54, the engagement prong 55 resists the force added by the force imparting member 58 and becomes removed from the second engagement recess 45*b*.

In this way, the engagement between the engagement prong 55 and the second engagement recess 45*b* is released, and as illustrated in FIG. 12B, the stopper 40 moves upward in relation to the engagement prong 55 in accordance with the force added by force imparting members 48*a* and 48*b*. Thus, the engagement prong 55 abuts with the area between the first engagement recess 45*a* and the second engagement recess 45*b*, and the stopper 40 returns to the initial position. Note that, even when the engagement prong 55 engages to the first engagement recess 45*a* and the stopper 40 is locked into the first position, by pressing the operating unit 51 the lock is released.

An embodiment of the present invention has been discussed above, but the present invention is not limited to the specific embodiment. Within the scope of the description of the present invention as claimed, the present invention may undergo various changes, including changes in shape.

The storage device 30 may also be such that the first unit 10*a* and the second unit 10*b* are not electronic devices. The storage device 30 may also include only one opening 32. The stopper 40 may have as little as one abutment portion 44.

All examples and conditional language recited herein are intended for pedagogical objects to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

The invention claimed is:

1. A storage device for storing units, the storage device comprising:

a housing, wherein selective insertion of one of a first unit and a second unit that respectively have different shapes is possible;

a stopper positioned such that movement is possible between an initial position, a first position wherein insertion of the first unit is allowed and insertion of the second unit is prevented, and a second position wherein insertion of the second unit is allowed and insertion of the first unit is prevented, wherein insertion of the first unit moves the stopper from the initial position to the first position and insertion of the second unit moves the stopper from the initial position to the second position; and a lock capable of locking the stopper into one of the first position and the second position.

2. The storage device of claim 1, wherein the stopper includes a first guidance recess engaging with the first unit and guiding the stopper from the initial position to the first position, and a second guidance recess engaging with the second unit and guiding the stopper from the initial position to the second position.

3. The storage device of claim 2, wherein the second guidance recess is not engagable with the second unit when the stopper is in the first position, and the first guidance recess is not engagable with the second unit when the stopper is in the second position.

4. The storage device of claim 3, wherein the stopper further includes an abutment portion abutting with the second unit when the stopper is in the first position and abutting with the first unit when the stopper is in the second position.

5. The storage device of claim 4 further comprising:

an elastic member moving the stopper between the initial position, the first position, and the second position.

6. The storage device of claim 5 wherein the housing includes a first opening, wherein selective insertion of one of a first unit and a second unit is possible; a second opening, wherein selective insertion of one of a first unit and a second unit is possible; and a dividing wall dividing the first opening and the second opening and housing the stopper.

7. A storage system capable of storing units, comprising:

a first unit;

a second unit having a different shape than the first unit;

a storage device storing the first unit and the second unit, the storage device including a housing wherein selective insertion of one of the first unit and the second unit is possible;

a stopper positioned such that movement is possible between an initial position, a first position wherein insertion of the first unit is allowed and insertion of the second unit is prevented, and a second position wherein insertion of the second unit is allowed and insertion of the first unit is prevented, wherein insertion of the first unit moves the stopper from the initial position to the first position and insertion of the second unit moves the stopper from the initial position to the second position; and a lock capable of locking the stopper into one of the first position and the second position.

* * * * *